US005561255A

United States Patent [19]

Sassmannshausen et al.

[11] Patent Number: 5,561,255

[45] Date of Patent: Oct. 1, 1996

[54] TENSIONING DEVICE FOR THE SKINS OF PERCUSSION INSTRUMENTS

[75] Inventors: Werner Sassmannshausen, Bad Berleburg-Berghausen; Werner Sassmannshausen, Bad Berleburg-Wingeshausen, both of Germany

[73] Assignee: SONOR Johs. Link GmbH, Bad Berleburg, Germany

[21] Appl. No.: 343,437

[22] PCT Filed: Nov. 10, 1993

[86] PCT No.: PCT/EP93/03145

§ 371 Date: Dec. 14, 1994

§ 102(e) Date: Dec. 14, 1994

[87] PCT Pub. No.: WO94/22129

PCT Pub. Date: Sep. 29, 1994

[30] Foreign Application Priority Data

Mar. 25, 1993 [DE] Germany ..... 9304543 U

[51] Int. Cl.[6] ..... G10D 13/02

[52] U.S. Cl. ..... 84/413

[58] Field of Search ..... 84/413, 411 R

[56] References Cited

U.S. PATENT DOCUMENTS

| | | | |
|---|---|---|---|
| 4,750,401 | 6/1988 | Hoshino | 84/413 |
| 4,928,566 | 5/1990 | Yanagisawa | 84/413 |

FOREIGN PATENT DOCUMENTS

| | | |
|---|---|---|
| 4141583 | 7/1992 | Germany . |
| 2017998 | 10/1979 | United Kingdom . |
| 9215984 | 9/1992 | WIPO . |

*Primary Examiner*—Patrick J. Stanzione
*Attorney, Agent, or Firm*—Friedrich Kueffner

[57] ABSTRACT

A tensioning device for the skins of percussion instruments includes a plurality of bearing brackets which are provided with threads and are arranged distributed over the circumference of the instrument shell. Tensioning screws are adjustably mounted in the bearing brackets and act on a hoop for holding the skin. A clamping piece of an elastomer material which surrounds each tensioning screw serves to secure the screws automatically in each tensioning position relative to the bearing bracket or a thread in the bearing bracket. The clamping piece is mounted so as to be in positively locking engagement with a structural component of the tensioning device.

6 Claims, 4 Drawing Sheets

FIG.1
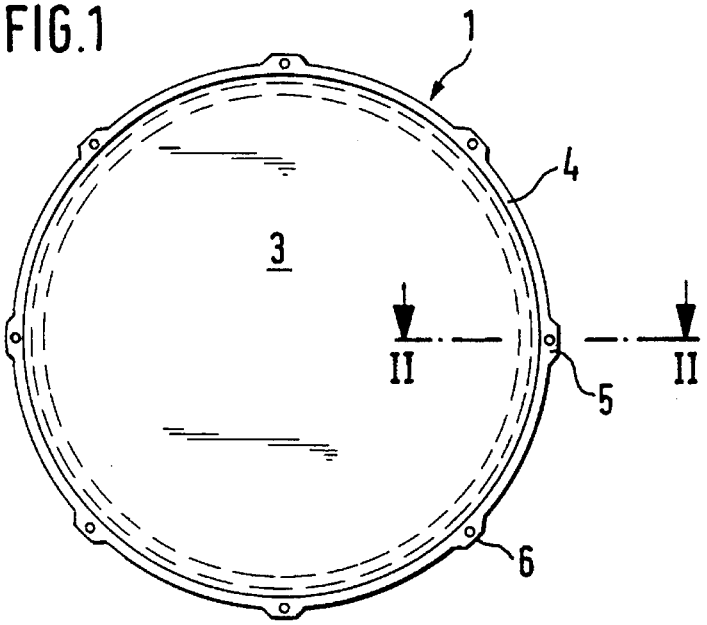
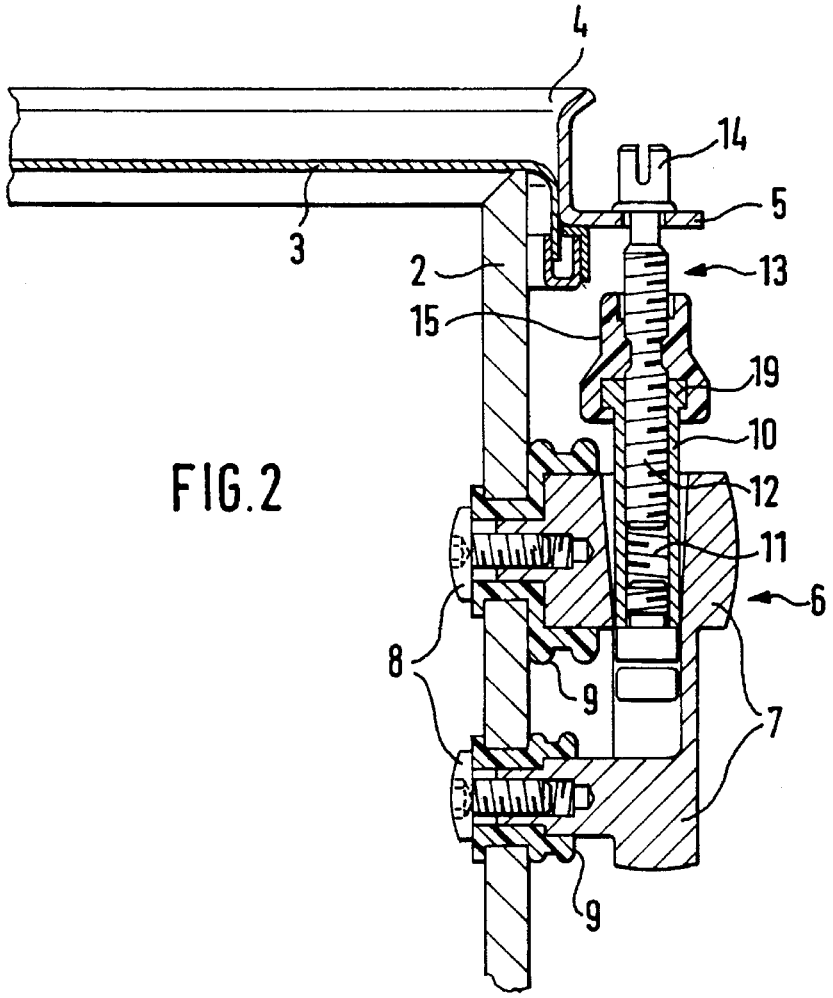
FIG.2

FIG.7
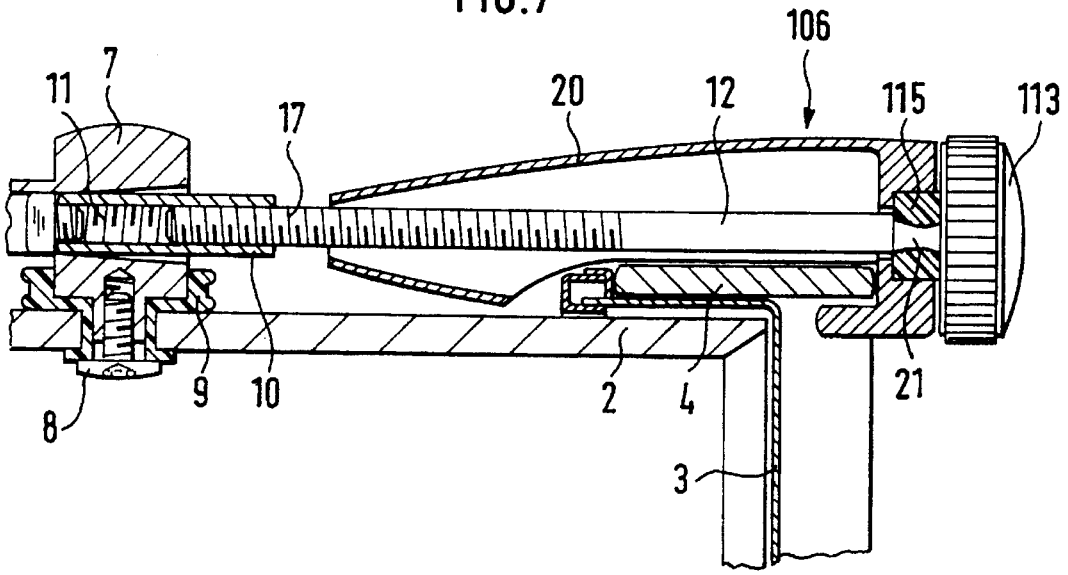
FIG.8
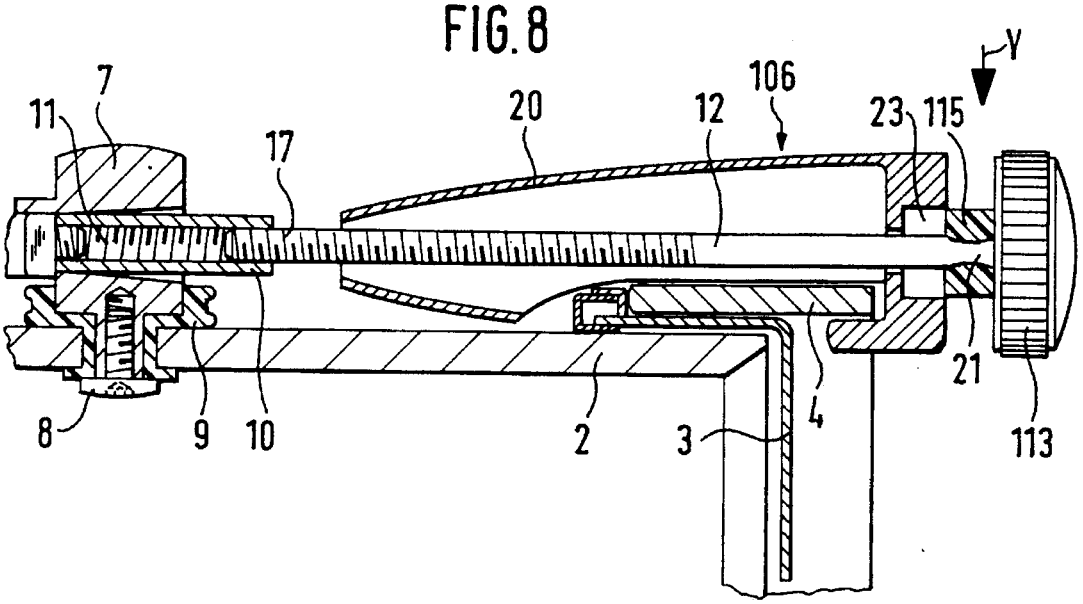
FIG.9
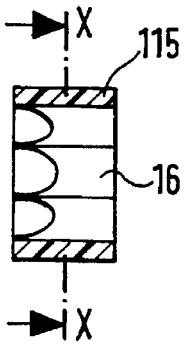
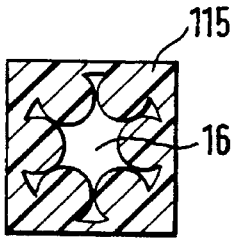
FIG.10

TENSIONING DEVICE FOR THE SKINS OF PERCUSSION INSTRUMENTS

BACKGROUND OF THE INVENTION

1. Field of the Invention

The invention relates to a tensioning device for the skins of percussion instruments, composed of several bearing brackets which are provided with threads and are arranged distributed over the circumference of the instrument shell, and screws which are adjustable in the bearing brackets and act on a hoop for holding the skin. By means of a clamping piece of an elastomer material which surrounds the tensioning screw, the screws can be secured automatically in each tensioning position relative to the bearing bracket or the threads in the bearing brackets.

2. Description of the Related Art

A tensioning device of this type has become known from DE 41 06 492 A1. The clamping piece has an opening through which extends directly the thread of the screw or a threaded sleeve receiving the screw, wherein the smallest width of the opening is below the external diameter of the thread of the screw or of the threaded sleeve. As the material for the clamping piece, all those materials having rubber-like elasticity can be used which are available for the technical application. The clamping pieces can be manufactured particularly of natural rubber, synthetic rubber, rubber-like materials or also other synthetic materials.

Since the smallest width of the opening—which may be circular or may have any other contour shape—is never greater than the external diameter of the thread at the shaft of the screw, it is achieved that the thread of the screw shaft penetrates into the walls of the opening while the material of the clamping piece is elastically deformed. As a result, the thread is subjected to a constant breaking force which has the purpose of preventing an automatic or undesired turning of the screw relative to the tensioning device. A non-rotating abutment for the clamping piece may be formed by the bearing bracket and/or directly by the shell body or the like of the percussion instrument which supports the bearing bracket. Accordingly, the breaking force acting on the screw is produced exclusively by the fact that the thread of the screw engages with elastic deformation of the clamping piece in the walls of the opening.

In a tensioning device known from DE 28 13 883 C2, the screws are provided at their shafts with at least one flattened or indented circumference portion which can be placed within the threaded bushings or sleeves in a circumference portion of a spring stirrup with radial pretensioning and, thus, forms with the flattened or indented circumference portion a turning and lock device between the screw and the threaded sleeve. This manner of securing the position of the tensioning device not only offers a self-locking effect in any chosen position of rotation between the screw and the threaded sleeve, but it additionally produces a positively locking effect in certain relative positions between screws and threaded sleeves. However, this requires a relatively complicated construction and, therefore, results in a high expenditure in the manufacture of percussion instruments.

SUMMARY OF THE INVENTION

Therefore, it is the object of the invention, in a tensioning device of the above-mentioned type, to improve in a simple manner the secure positioning by means of an elastomer clamping piece.

In accordance with the invention, this object is met by arranging the clamping piece in a positively locking manner in the tensioning device. As a result, it is possible to achieve a secure positioning also with an elastomer clamping piece placed on the tensioning screw or the threaded sleeve, which ensures, in addition to the already existing self-locking effect of the threaded connection, an additional positively engaging locking effect.

In accordance with a proposal of the invention, it is provided that the clamping piece extends with a polygonal internal recess over a corresponding polygonal projection of a threaded sleeve surrounding the tensioning screw, wherein the recess or projection may preferably be constructed as squares. Accordingly, the clamping piece ensures a threefold locking effect, namely, first by the self-locking effect between the tensioning screw and the threaded sleeve, and further by the constant breaking force achieved as a result of the smaller opening as compared to the external diameter of the thread at the shaft of the screw, and in addition by the positively locking connection as a result of the engagement of the polygonal internal recess and the polygonal projection which excludes a rotation with certainty. Consequently, the clamping piece has the opening which is smaller as compared to the tensioning screw, on the one hand, and the contour of, in this case, the internal recess which excludes a rotation.

Another development of the invention provides that the clamping piece has a polygonal outer contour and engages in a corresponding polygonal recess of a tensioning angle which receives the tensioning screw, wherein these contours may also be advantageously constructed square. Consequently, in this solution, the positively locking connection is effected by the engagement of the polygonal clamping piece which surrounds with its opening the tensioning screw into the correspondingly shaped recess of the tensioning angle.

In accordance with another embodiment of the invention which includes the use of a tensioning angle, it is proposed that the clamping piece is provided with a web-like extension which has at its free end a hook, wherein the extension engages over the tensioning hoop. In this case, the positively locking connection is effected as a result of the hook of the clamping piece extension being placed over the tensioning hoop. An additional advantage achieved in this case is a protection of the tensioning hoop because the web-like clamping piece extension rests against the tensioning hoop.

Additional features and advantages of the invention result from the claims and the following description in which several embodiments of the subject matter of the invention are explained in more detail.

BRIEF DESCRIPTION OF THE DRAWINGS

In the drawing:

FIG. 1 shows in a top view a drum or bass drum equipped with a tensioning device for the skin or skins;

FIG. 2 is a longitudinal sectional view of a tensioning device taken along line II—II of FIG. 1;

FIG. 7 shows as a detail another embodiment of a tensioning device which includes a tensioning angle, illustrated in the tensioned state of the skin;

FIG. 8 shows the tensioning device of FIG. 7 in the released state;

FIG. 9 shows in a longitudinal sectional view as a detail the clamping piece indicated FIG. 8 by "Y";

FIG. 10 is a sectional view of the clamping piece taken along line X—X of FIG. 9;

DETAILED DESCRIPTION OF THE PREFERRED EMBODIMENTS

Figure 3:
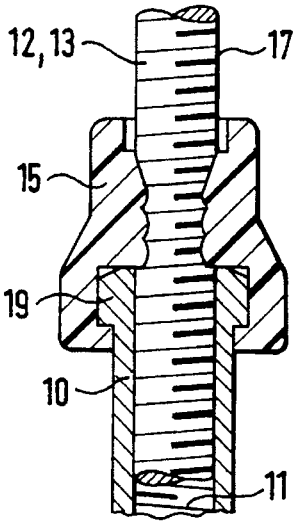
FIG. 3 shows in a longitudinal sectional view the detail in the dash-dot circle indicated by "X" in FIG. 2.

FIG. 1 shows, as an example for the use of the invention, a drum 1 which has an angular shell 2, wherein the skin 3 is placed over one end of the shell 2. The skin 3 is fastened with its edges in a hoop 4 which surrounds the upper end of the shell 2 with concentric play. The hoop has a radial flange 5, wherein, in accordance with FIG. 1, eight tensioning devices 6 act on the radial flange 5. The tensioning devices 6 are uniformly distributed over the circumference of the drum 1. Each tensioning device 6 has a bearing or a support bracket 7 which is rigidly arranged on the outer side of the drum shell 2 (see FIG. 2). The bearing bracket 7 is either provided directly with an internal thread or has a threaded sleeve with an appropriate internal thread.

As can be seen in the embodiment of FIG. 2, the bearing bracket 7, which is fastened in the drum shell 2 by means of screws 8 and elastic collars 9 arranged between the drum shell 2 and the screws 8, receives a threaded sleeve 10 with an internal thread 11 which is in engagement with the shaft 12 of a tensioning screw 13. The tensioning screw 13 has in its head 14 a radial adjusting slot which permits turning of the tensioning screw 13 by means of a suitable screwdriver. Turning of the tensioning screw 13 has the effect that the tensioning screw 13 with its shaft 12 is axially displaced in the internal thread 11, so that through the hoop 4 the tension of the skin supported at one end of the drum shell 2 can be changed. The head 14 of the tensioning screw 13 acts on the upper side of the radial flange 5 of the hoop 4.

Figure 4:
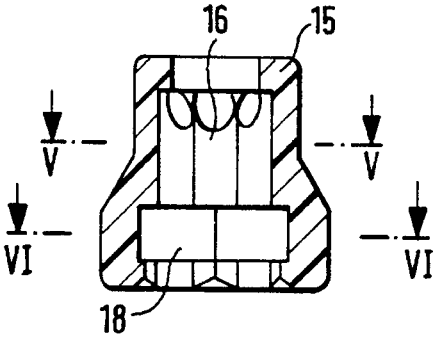
FIG. 4 shows as a detail an elastomer clamping piece in longitudinal section.
Figure 5:
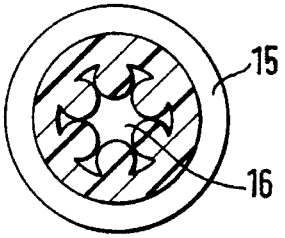
FIG. 5 is a sectional view of the clamping piece taken along line V—V of FIG. 4.
Figure 6:
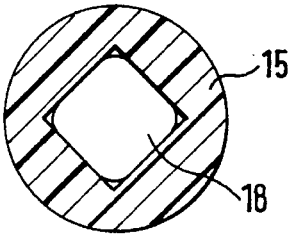
FIG. 6 is a sectional view of the clamping piece taken along line VI—VI of FIG. 4.

To ensure that the tensioning screw 13 with its shaft 12 cannot be displaced unintentionally relative to the internal or female thread 11 of the threaded sleeve 10, special safety precautions have been made in the area of each tensioning device 6. These safety precautions include an elastomer clamping piece 15 which has a central opening 16 (see FIG. 5) whose smallest opening width is smaller than the external thread diameter of the shaft 12 of the tensioning screw 13. As a result, the turns of the thread 17 of the screw shaft penetrate into the walls of the opening 16 and elastically deform the material of the clamping piece 15 (see FIG. 3) and, thus, are subjected to a continuous breaking force which contributes to a prevention of an automatic or undesired turning of the tensioning screw 13 relative to the tensioning device 6. On the other hand, the clamping piece 15 is provided with a polygonal internal recess 18 which continues the opening 16 (see FIGS. 4 and 6), wherein the internal recess makes it possible to additionally produce a positively locking connection which secures the position of the tensioning screw 13 and prevents rotation. For this purpose, the threaded sleeve 10 is provided with a corresponding square projection 19 (see FIG. 3), wherein the elastomer clamping piece 15 can be placed over the projection 19. The engagement of the square projection 19 in the internal recess 18 of the clamping piece 15 having the corresponding contour safely prevents undesired rotations of the tensioning screw 13.

In the embodiment of a tensioning device 106 illustrated in FIGS. 7 and 8, the skin 3 is tensioned or released by means of a tensioning angle 20. The tensioning angle engages over the hoop 4 and, when tightening a tensioning screw 113 which extends with its shaft 12 through the tensioning angle 20 and is screwed into the bearing bracket 7, the tensioning angle acts through the hoop 4 on the skin 3. The elastomer clamping piece 115 has also in this case a central opening 16 (see FIGS. 9 and 10) whose smallest diameter is smaller than the outer diameter of the thread-free projection 21 of the tensioning screw 113. However, in this case, the clamping piece 115 surrounds a thread-free portion 21 which is constructed as a groove in the shaft 12 of the tensioning screw 113. This ensures that the clamping piece 115 is secured in its position in axial direction.

In order to achieve, for securing the position by means of the elastomer clamping piece 115 an additional positively locking connection to prevent rotation, the clamping piece 115 has a square outer contour (see FIG. 10) which corresponds to a square recess 23 in the tensioning angle 20. If, for changing the skin, the tensioning angle 20 and the tightening screw 113 are to be disassembled quickly, it is merely necessary to screw the tensioning screw 113 from its tensioning position shown in FIG. 7 out of the threaded sleeve 10 of the bearing bracket 7. Because the clamping piece 115 is secured in its position in the groove of the tensioning screw (thread-free portion 21), the clamping piece 115 is released from the non-rotatable seat of the recess 23 of the tensioning angle 20, so that a quick disassembly of the drum skins is made possible. The breaking effect of the clamping piece 115 is eliminated during this phase.

Figure 11:
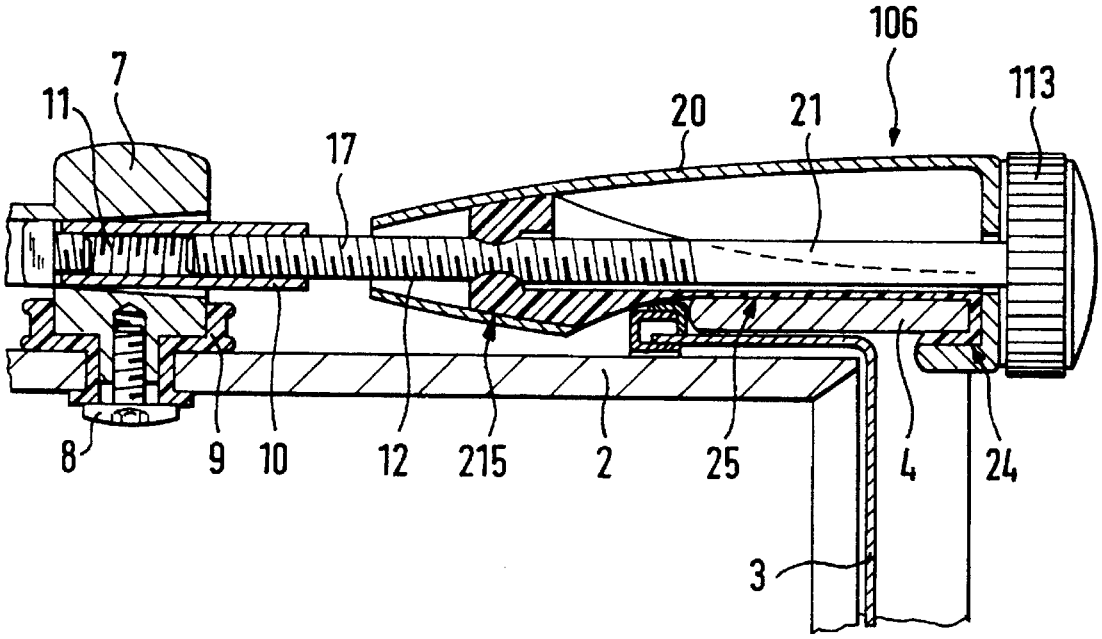
FIG. 11 shows as a detail another embodiment of a tensioning device with the a clamping piece according to the invention which includes a tensioning angle.

The embodiment of the tensioning device 106 using a tensioning angle 20 illustrated in FIG. 11 differs from the device described above in connection with FIGS. 7–10 in that the clamping piece 215 has a different shape. The clamping piece 215 is arranged in the tensioning angle 20 so as to surround the thread 17 of the shaft 12 of the tensioning screw 113. The clamping piece 215 additionally has a web-like extension 25 which has a hook 24 at its free end. In this case, the additional and non-rotatable positively locking connection for securing the position is achieved by the hook 24 of the extension 25 of the clamping piece 215 which engages over the hoop 4. Simultaneously, the shape of the clamping piece 215 contributes to being a projection of the hoop 4.

We claim:

1. A tensioning device for the skins of percussion instruments, the tensioning device comprising a plurality of bearing brackets having threads and being arranged distributed over a circumference of an instrument shell, and tensioning screws adjustably mounted in the bearing brackets for acting on a hoop for holding the skin, further comprising a clamping piece of an elastomer material surrounding each tensioning screw for securing the tensioning screw in tensioning positions relative to the bearing bracket or the threads in the bearing brackets, wherein the clamping piece has a polygonal internal recess, further comprising a threaded sleeve surrounding each tensioning screw, and wherein the threaded sleeve has a polygonal projection engaging the polygonal internal recess of the clamping piece.

2. The tensioning device according to claim 1, wherein the internal recess and the projection are square.

3. A tensioning device for the skins of percussion instruments, the tensioning device comprising a plurality of bearing brackets having threads and being arranged distributed over a circumference of an instrument shell, and tensioning screws adjustably mounted in the bearing brackets for acting on a hoop for holding the skin, further comprising a clamping piece of an elastomer material surrounding each tensioning screw for securing the tensioning screw in tensioning positions relative to the bearing bracket or threads in the bearing brackets, wherein the clamping piece has a polygonal outer contour, further comprising a tensioning angle for receiving each tensioning screw, and wherein the polygonal outer contour of the clamping piece engages in a corresponding polygonal recess of the tensioning angle.

4. The tensioning device according to claim 3, wherein the clamping piece is mounted such that, when the skin is released by means of the tensioning screws, the clamping piece is released from the recess of the tensioning angle and loses a braking effect acting on the tensioning screw.

5. The tensioning device according to claim 3, wherein the clamping piece and the recess are square.

6. A tensioning device for the skins of percussion instruments, the tensioning device comprising a plurality of bearing brackets having threads and being arranged distributed over a circumference of an instrument shell, and tensioning screws adjustably mounted in the bearing brackets for acting on a hoop for holding the skin, further comprising a clamping piece of an elastomer material surrounding each tensioning screw for securing the tensioning screw in tensioning positions relative to the bearing bracket or threads in the bearing brackets, wherein the clamping piece is mounted in a tensioning angle, the clamping piece further comprising a web-like extension with a hook at a free end of the web-like extension, and wherein the web-like extension engages the hoop.

* * * * *